United States Patent [19]

Blakesley et al.

[11] 3,975,079

[45] Aug. 17, 1976

[54] PIN AND SOCKET TERMINAL CONNECTOR USING CLAD MATERIAL

[75] Inventors: Roland Francis Blakesley, Novelty; Daniel Lincoln Dunn, Aurora, both of Ohio

[73] Assignee: International Telephone and Telegraph Corporation, New York, N.Y.

[22] Filed: Apr. 11, 1975

[21] Appl. No.: 567,121

[52] U.S. Cl. ..... 339/278 C

[51] Int. Cl.[2] ..... H01R 13/02

[58] Field of Search ..... 339/275, 278; 200/262, 200/267–269

[56] References Cited

UNITED STATES PATENTS

| | | | |
|---|---|---|---|
| 1,936,469 | 11/1933 | Hill | 339/278 C |
| 2,689,337 | 9/1954 | Burtt et al. | 339/275 T |
| 2,711,524 | 6/1955 | Beaver | 339/275 T |
| 2,754,393 | 7/1956 | Clair, Jr. | 200/267 |
| 2,846,649 | 8/1958 | Hornauer | 339/278 C |

*Primary Examiner*—Joseph H. McGlynn
*Attorney, Agent, or Firm*—James B. Raden; William J. Michals

[57] ABSTRACT

A pin and socket connector is disclosed wherein the electrically mating surfaces of the terminals are provided with a clad material having superior conductivity characteristics relative to the base material of the terminals. The clad material of the socket is provided in the form of a band along an inner circumference thereof, and the clad material of the pin is also provided as a band along an outer circumference thereof, thereby to provide a complementary coinciding surface thereof. The inside diameter of the socket band is slightly less than the outside diameter of the pin band but the inside diameter of the remainder of the socket is slightly greater than the outside diameter of the pin band. Accordingly, friction between the clad material band of the pin terminal and the socket terminal body during engagement is substantially minimized until the pin band slidably engages the socket band whereupon the respective inside and outside diameters are substantially equal and maximum electrical connection between the respective terminals is provided.

5 Claims, 6 Drawing Figures

10
12
14
16
20
22
P
S
2
3
5
6-6

PIN AND SOCKET TERMINAL CONNECTOR USING CLAD MATERIAL

BACKGROUND OF THE INVENTION

This invention relates to electrical connectors and, more particularly, to pin and socket connector terminals provided with coinciding clad metal portions to enhance electrical connection therebetween.

Pin and socket connector terminals are well known in the art and have been used to provide electrical connections for numerous electrical equipment, appliances, computers, and the like. These connector terminals are generally mounted in separable, mating housing members or sections which provide proper alignment between the corresponding pins and sockets, protection therefore, and insulation thereof. Connectors of this type provide a convenient and relatively inexpensive means of providing electrical connections between remote components in a given application.

It has been found, however, that these connectors are not always suitable for applications in hostile environments such as those found in automobile or truck vehicles applications. That is, since these applications are subject to contamination such as grease and/or salt spray, the electrical connections tend to develop high resistance paths or even open faults. This is particularly true where the separable sections of the connector must occasionally be separated such as between the cab and trailer of a truck vehicle application. Thus, it has heretofore been the standard practice of utilize sophisticated and relatively expensive weather proof connectors of the type wherein the mating terminals are individually fabricated, such as by a screw-machine type process.

These and other disadvantages are overcome by the present invention wherein there is provided a connector utilizing relatively simple connector housing and wherein the coinciding contact surfaces of the terminals are provided with a clad material having superior conductivity characteristics relative to the base metal material of the terminal bodies.

SUMMARY OF THE INVENTION

Briefly, an electrical connector is provided comprising an insualted housing having first and second separable sections and at least one passaeway extending therethrough. A pin terminal and a socket terminal are respectively disposed in the first and second sections. Each of the terminals includes means at one end thereof for securing a conductor thereto. The body of the pin terminal has substantially the same outside diameter therealong, and has a clad metal portion along an outer circumference thereof which is spaced a given distance from the tip of the pin terminal. The body of the socket terminal has substantially the same inside diameter therealong except at a clad metal portion which is spaced a given distance from the tip of the socket terminal and wherein the inside diameter of the clad portion of the socket is significantly less than the outside diameter of the clad portion of the pin terminal. Accordingly, when the connector sections engage the clad metal portions experience minimal frictional engagement until the clad portions coincide whereupon the electrical and mechanical connection therebetween is maximized.

BRIEF DESCRIPTION OF THE DRAWING

The advantages of this invention will become more readily appreciated as the same becomes completely understood by reference to the following detailed description when taken in conjunction with the accompanying drawing wherein.

DETAILED DESCRIPTION

Figures 1, 2, 3, 4, 5, 6:
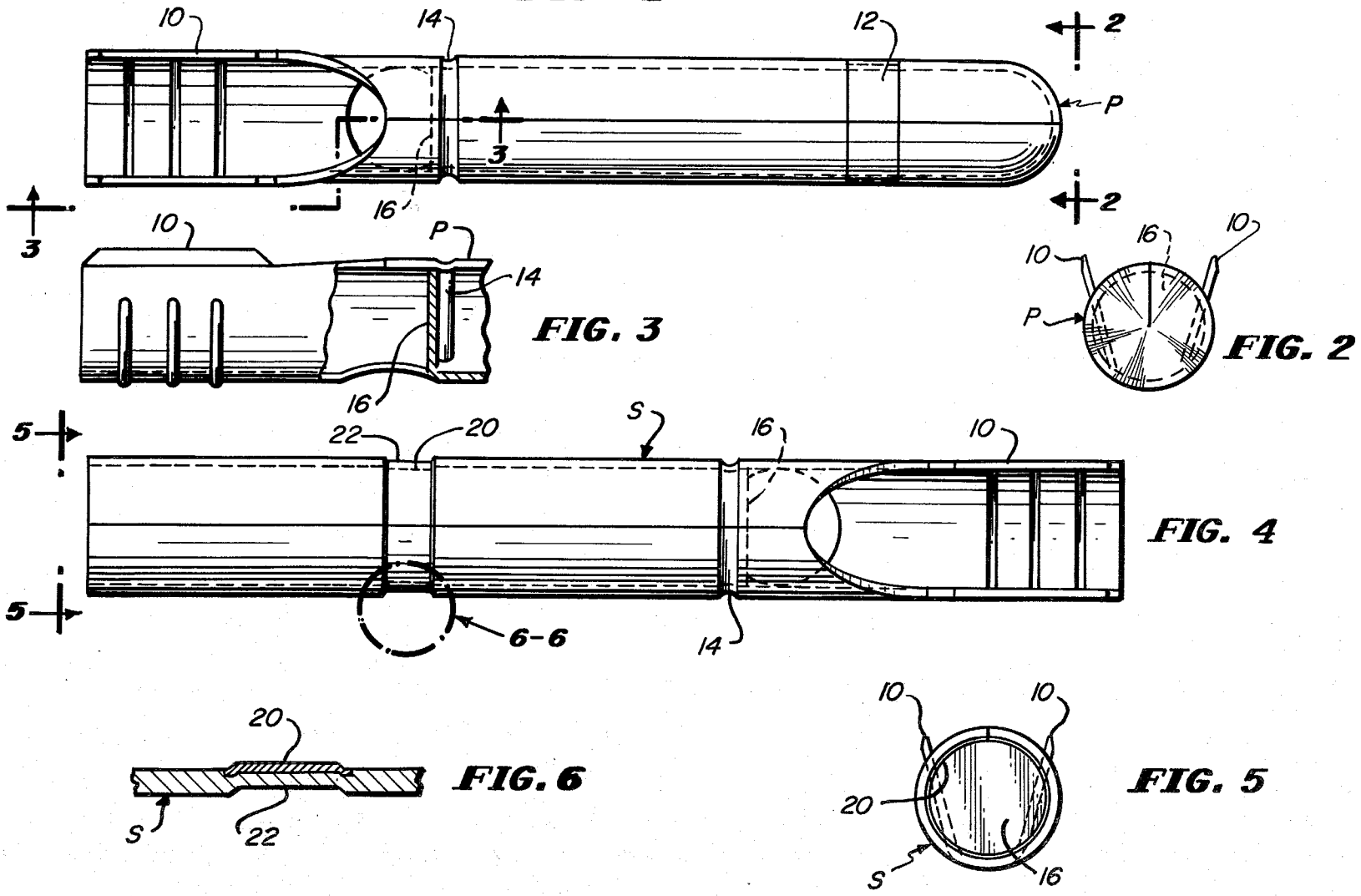
FIG. 1 is a perspective view of the pin terminal.
FIG. 2 is an end view of the pin terminal.
FIG. 3 is an enlarged and partially sectioned side view of the pin terminal illustrating particularly an integral barrier wall provided therein.
FIG. 4 is a perspective view of a socket terminal.
FIG. 5 is an end view of the socket terminal.
FIG. 6 is a partial sectional view of the socket terminal illustrating the provision of a clad material having a reduced inside diameter.

Referring now to FIGS. 1 and 2, the pin element P includes a wire gripping portion 10 in which a conductor wire is secured, cold-forged or suitably crimped as is well known in the art. Section 10 may also include a section to engage the insulation portion of the associated conductor. The terminal is preferably formed by stamping or shaping a sheet metal blank or strip of suitable conductive material such as brass, bronze, or any other suitable metal of sufficient hardness and resiliency to provide the desired spring qualities to meet a given application.

Terminal P is provided with an inlayed cladding 12 of gold, silver, platinum or their alloys to serve as an electrical contact. The cladding is preferably provided as an inlayed stripe so that the stamping and forming operation, with the clad metal, is performed as fast and satisfactory as with the base metal alone. As will be discussed more fully hereinafter, clad band 12 is provided at a given distance from the tip of terminal P somewhat near the tip of the terminal. Terminal P is also provided with a reduced or neck portion 14 and a barrier wall 16 which is stamped from and out of the body of terminal P. The details of barrier wall 16 are best shown in FIG. 3 wherein there is provided an enlarged side view in partial section. As described more fully hereinafter, the function of barrier wall 16 is to prevent the flow of any connector housing material into the main body portion of terminal P such as during a molding process when a rubber or elastomeric material is molded about terminal P.

Referring now to FIGS. 4 and 5, there is shown a socket terminal S. The structural details of this socket S are similar to the structural details of end terminal P and, accordingly, like elements bear like reference numerals. Socket terminal S is also provided with a cladding 20 of clad material which is clad along an inner circumference thereof. Cladding 20 of socket S is also perferably provided as an inlayed stripe to facilitate the stamping and forming operation of socket terminal S. The outer portion of socket S which overlies cladding 20 is reduced or stepped radially inwardly so that cladding 20 exhibits a somewhat reduced inside diameter relative to the remaining portion of socket S. This feature is illustrated somewhat more clearly in FIG. 6, wherein it can be seen that by reducing a portion of the body of socket S at 22 results in a corresponding translation of cladding 20 in a radially inward direction.

Figure 7:
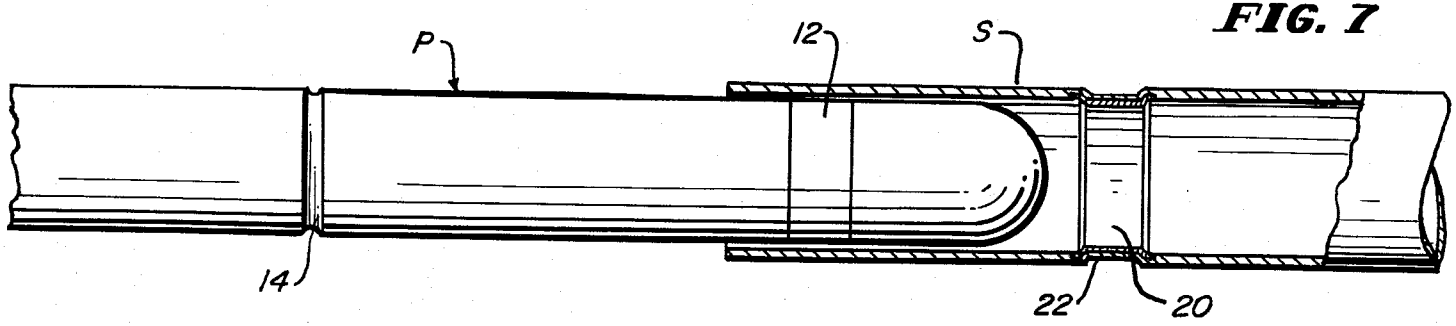
FIG. 7 is a partially sectioned view showing the pin and socket in a partially mated relationship; and, FIG. 8 is a partially sectioned view showing the pin and socket in mated relationship in their respective housing sections which are also in mated relationship.
Figure 8:
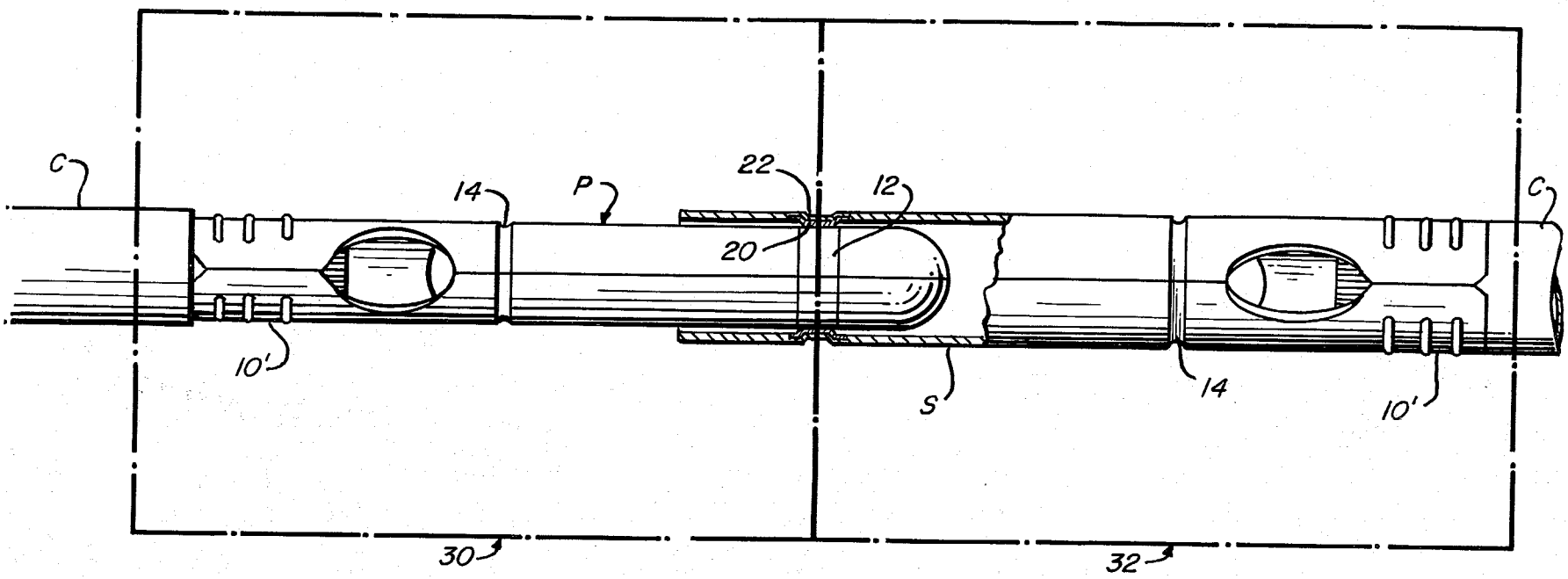

By way of illustration, in one constructed embodiment pin terminal P and socket terminal S were provided nominally as 0.187 terminals. In this embodiment the outside diameter of pin terminal P, including inlayed cladding 12, was 0.185; and the inside diameter of socket terminal S, except at cladding portion 20, was 0.188 inches. The inside diameter of cladding portion 20 of terminal S, due to the reduced or necked portion, was 0.181 inches. Accordingly, as the pin end socket terminals were initially engaged, as illustrated in FIG. 7, clearance was provided between the outside diameter of pin terminal P and the inside diameter of socket terminal S. However, as the terminals were advanced toward one another toward the position illustrated in FIG. 8, the tip of end terminal P slidably engaged cladding portion 20 of socket terminal S. This sliding engagement continued until the separable sections of a housing graphically depicted as 30 and 32, respectively, in FIG. 8 engaged. At this point the pin terminal P was driven home wherein its cladding portion 14 coincided with cladding 20 of socket terminal S.

As previously discussed, clad portion 12 of pin terminal P is provided at a given distance from the tip of terminal P but relatively close to the tip of terminal P. This is done to allow pin terminal P to somewhat self-align itself as it is initially advanced into socket terminal S. Further, once the tip of pin terminal P engages the inside diameter of cladding 20, some "wiping" action occurs but is limited to the distance between the tip of terminal P and clad portion 12. However, the clad portion 12 of terminal P avoids frictional engagement with socket terminal S until cladding portions 12 and 20 coincide one another.

In a currently preferred application of the present invention, wherein the connector in accordance with the principles of the present invention is utilized as a connector connecting the respective electrical wiring of a truck vehicle cab and trailer, housing sections 30 and 32 are provided as molded members of elastomeric material. That is, after conductors C are suitably crimped to wire barrier portion 10′ of FIG. 8, housing sections 30 and 32 are respectively molded about terminals P and S so that the terminals are fully mated when housing sections 30 and 32 are mated. As previously discussed, barrier wall 16 is provided in each of the terminals so that the flow of any excess housing material into the bodies of the terminals is prevented or avoided.

What has been taught then, is a pin and socket terminal connector using clad material to enhance its conductivity characteristics, thereby to facilitate, notably, a connector for use in truck vehicle applications, such as between the truck cab and trailer. The form of the invention illustrated and described herein is but a preferred embodiment of these teachings. It is shown as an illustration of the inventive concept, however, rather than by way of limitation, and it is pointed out that various modifications and alterations may be indulged in within the scope of the appended claims.

What is claimed is:

1. An electrical connector comprising an insulated housing having first and second separable sections and at least one passageway extending therethrough, a pin terminal and a socket terminal respectively disposed in said first and second sections, each of said terminals having means at one end thereof for securing a conductor thereto, the body of said pin terminal having substantially the same outside diameter therealong and having a clad metal portion along an outer circumference thereof which is spaced a given distance from the tip of said pin terminal, the body of said socket terminal having substantially the same inside diameter therealong except at a clad metal portion which is spaced a given distance from the tip of said socket terminal, wherein the inside diameter of said clad portion of said socket is significantly less than the outside diameter of said clad portion of said pin terminal prior to engagement of said terminals, thereby to provide increased frictional engagement between said clad portion of said socket and said clad portion of said pin terminal when said terminals are engaged, wherein the inside diameter of said socket terminal is significantly greater than the inside diameter of said clad portion of said socket terminal, and wherein said clad material portions comprise an inlaid band and wherein the outside circumference of said socket terminal is deformed inwardly in the area of said inlaid band to reduce the inside diameter of said inlaid band of said socket.

2. The connector according to claim 1, wherein each of said terminals comprises a substantially tubular body having a longitudinal slot extending from end to end thereof.

3. An electrical connector comprising an insulated housing having first and second separable sections and at least one passageway extending therethrough, a pin terminal and a socket terminal respectively disposed in said first and second sections, each of said terminals having means at one end thereof for securing a conductor thereto, the body of said pin terminal having substantially the same outside diameter therealong and having a clad metal portion along an outer circumference thereof which is spaced a given distance from the tip of said pin terminal, the body of said socket terminal having substantially the same inside diameter therealong except at a clad metal portion which is spaced a given distance from the tip of said socket terminal, wherein the inside diameter of said clad portion of said socket is significantly less than the outside diameter of said clad portion of said pin terminal prior to engagement of said terminals, thereby to provide increased frictional engagement between said clad portion of said socket and said clad portion of said pin terminal when said terminals are engaged, wherein the inside diameter of said socket terminal is significantly greater than the inside diameter of said clad portion of said socket terminal, wherein each of said terminals includes a barrier wall formed from a portion of said body between said conductor securing means and said clad metal portion, and wherein said clad material portions comprise an inlaid band and wherein the outisde circumference of said socket terminal is deformed inwardly in the area of said inlaid band to reduce the inside diameter of said inlaid band of said socket.

4. The connector according to claim 3, wherein the material of said inlaid bands is Au.

5. The connector according to claim 4, wherein said first and second separable sections of said housing each comprise an elastomeric material molded about a respective one of said terminals.

* * * * *